United States Patent [19]

Savino

[11] 4,236,697

[45] Dec. 2, 1980

[54] CART STORAGE DEVICE

[76] Inventor: Alfred T. Savino, 5900 W. Sixty-Fifth St., Chicago, Ill. 60638

[21] Appl. No.: 949,072

[22] Filed: Oct. 6, 1978

[51] Int. Cl.[3] ..... E04H 17/00

[52] U.S. Cl. ..... 256/1; 256/25; 186/52

[58] Field of Search ..... 256/1, 25, 26; 52/DIG. 12; 182/178, 179; 119/20; 186/1 F, 1 P, 1 R

[56] References Cited

U.S. PATENT DOCUMENTS

| | | | |
|---|---|---|---|
| 1,452,875 | 4/1923 | Healy | 256/1 |
| 2,833,421 | 5/1958 | Skubic | 182/178 X |
| 3,160,292 | 12/1964 | Albrecht . | |
| 3,394,921 | 7/1968 | Greenfield | 256/1 |
| 3,459,280 | 8/1969 | Grimm . | |
| 3,473,484 | 10/1969 | Close . | |
| 3,561,567 | 2/1971 | Bradley | 186/1 |
| 3,700,074 | 10/1972 | Shoffner | 186/1 AC |

*Primary Examiner*—Andrew V. Kundrat

*Attorney, Agent, or Firm*—Neuman, Williams, Anderson & Olson

[57] ABSTRACT

A cart storage area for installation in parking lots, or the like, including upstanding rail guard elements and upwardly projecting framed notice means within which shopping carts may be directed and stored for recovery while being protected in said storage area from damage by vehicles using the lot.

8 Claims, 3 Drawing Figures

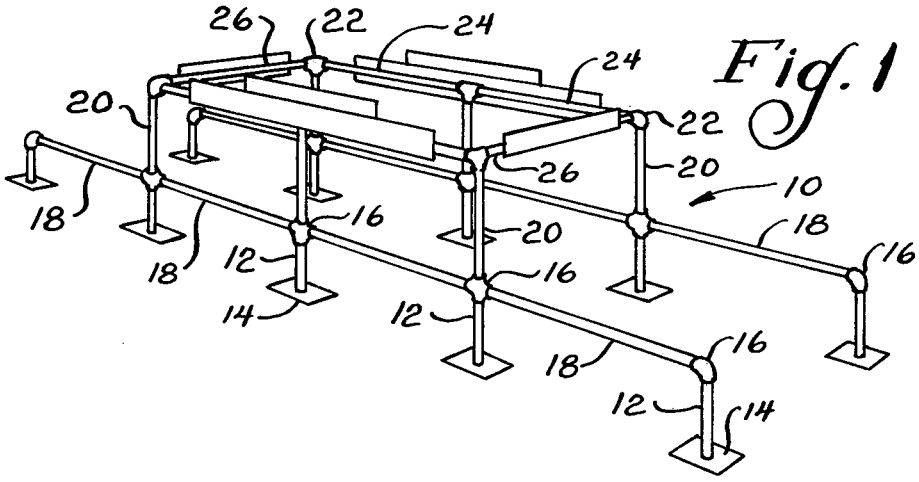
Fig. 1
Fig. 2
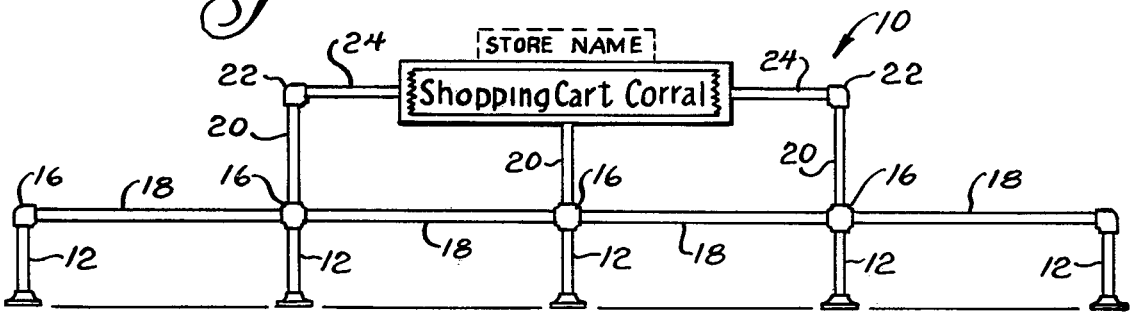
Fig. 3
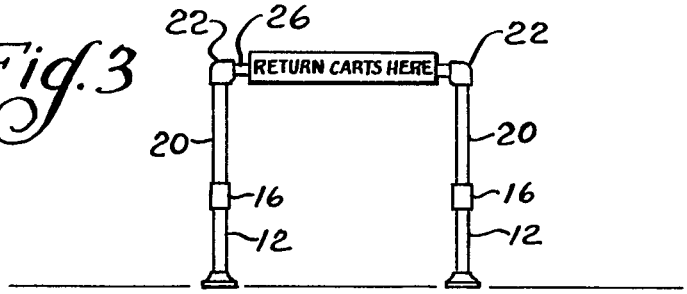

CART STORAGE DEVICE

BACKGROUND OF THE INVENTION

It is common knowledge that shopping carts, or the like, commonly are left in vehicle parking lots in a random manner by being abandoned immediately after use in carrying articles to the users' vehicle.

In this manner the carts are commonly located throughout the parking lot and become a hazard to users of the lot and cause a disturbance in movement of vehicles throughout the lot.

Various means have been defined from time to time to alleviate this problem but none have been successfully employed. Accordingly, the only common method in use for protection from random storage of shopping carts is that which provides for continuous manual recovery of the carts from the lots.

The present invention is directed to the provision of an improved storage area for shopping carts within a parking lot and, more specifically, for spaced provision of protected areas for storage of shopping carts so that the carts do not present a hazard to vehicles maneuvering in the lot.

Removal of shopping carts from random disposal in a parking lot area is desirable, of course, in that the carts are conveniently centrally located for the store owners to collect them when necessary and they are removed as hazards in the parking lot itself thereby providing greater utilization of the parking lot even though some minimal area may be lost for the provision of the subject shopping cart storage area or areas. It also is important to protect the carts themselves since they individually are relatively expense to repair and to replace.

It is, therefore, a primary object of the present invention to provide an improved storage area facility for storing shopping carts in a parking lot or large area.

Other objects and advantages of the present invention reside in the provision of an improved protected storage area for shopping carts which is economical to manufacture and to install and which is easy to use and durable in use.

The novel features which are believed to be characteristic of the invention are set forth with particularity in the appended claims. The invention itself, however, together with further objects and advantages thereof will best be understood by reference to the following description taken in connection with the accompanying drawings, in which:

FIG. 1 is a schematic view, in perspective, showing the shopping cart storage area of the present invention;

FIG. 2 is a side elevation of the apparatus of FIG. 1; and

FIG. 3 is an end view of the apparatus of FIG. 1.

Referring more particularly now to the drawings, the apparatus of the present invention is generally indicated at 10 in FIG. 1 and includes a plurality of upstanding post elements 12 which are anchored in the ground by insertion into concrete filled wells 14 or by anchoring to posts which, in turn, are anchored to the ground. The upstanding posts 12 are anchored in spaced-apart relation along a pre-determined array line in the area selected for the shopping cart storage facility, substantially as schematically illustrated in FIGS. 1 and 2 of the drawings. For example, two end to end parking spaces in the lot may be selected for this purpose wherein all of the carts used in the area may be temporarily store for later collection and where they will be removed from the otherwise usually congested parking lot facility.

Coupling elements 16 are secured to the upper terminals of the upstanding, spaced-apart posts 12 and adapted to be rigidly secured thereby by threadably fastening the same to the posts or by other suitable means of fastening such as welding, soldering, brazing, or the like.

A plurality of laterally extending tubular elements 18 are secured to the couplings 16 and extend between the upper terminals of the posts 12 to define a closed area between the array of posts 12 of the assembly so that a pair of spaced apart continuously defined horizontally extending rails are provided which enclose the sides of the storage area defined by the assembly. It should be noted that tubular elements are not essential to the structure herein and any particular geometric configuration may be employed in the assembly.

A second array of upstanding posts 20 are secured to the inner array of posts 12 in upstanding relation with respect thereto by securing of the second array 20 to the coupling units 16 associated with the posts 12 to define a second stage array in spaced apart relation as schematically represented in FIGS. 1 and 2 of the drawings. The upper terminals of the second, upper array of posts 20 are also provided with coupling units 22 to provide means to secure horizontally extending rail elements 24 therebetween.

End structure members 26 extend across the storage area defined between the horizontally extending rails 24 at the ends of the arrays of posts 20 to define means for stabilizing the entire structure with respect to side to side forces and to provide a unitary, complete structural assembly physically joining the vertically extending and horizontally extending post elements of the assembly.

It can readily be seen that in addition to providing means for stabilizing the entire structure, suitable indicia may be posted on the upper array of posts at the upper terminal thereof to give notice to the users of the shopping carts of the storage facility available for carts and of the exact location thereof.

The upper array is essential to the structure to provide for side to side stability of the structure and to provide for a unitized assembly in a manner that will not interfere with use of the shopping cart storage area. It can readily be seen that the horizontally extending posts or rail elements 26 are elevated above the area between the side rails within which the carts will be moved and, preferably, may be sufficiently high to permit humans to pass thereunder in placing shopping carts in the storage area defined by the assembly.

While I have shown and described a specific embodiment of the present invention it will, of course, be understood that other modifications and alternative constructions may be used without departing from the true spirit and scope of this invention. I therefore intend by the appended claims to cover all such modifications and alternative constructions as fall within their true spirit and scope.

I claim:

1. A facility for installation in parking lots, or the like, for storage of shopping carts and comprising:

two first parallel arrays of vertically extending posts, each parallel array having a plurality of posts extending in spaced apart relation in the array and including two terminal posts located at the ends of the array, the posts of the first arrays having one end thereof rigidly anchored to the parking lot and terminating in a free end and extending substantially vertically away from the parking lot surface;

coupling means affixed to the free ends of the vertically extending posts;

horizontally extending elements being anchored within the coupling means at the terminals of the vertically extending posts of the first parallel arrays and extending along each said array to define laterally spaced-apart protective rails in combination with the arrays;

two second parallel arrays of vertically extending posts with the posts of the second arrays having one end thereof rigidly anchored in the coupling means affixed to the free ends of the posts of the first arrays of vertically extending posts and terminating in free ends and extending away from said coupling means;

coupling elements affixed to the free ends of the posts in the second parallel arrays;

horizontally extending connecting elements being anchored within the coupling elements of the vertically extending posts of the second parallel arrays and extending along each second parallel array to define laterally spaced-apart rails in planar conjunction with the horizontally extending elements anchored to the first parallel arrays of posts; and cross members extending between the end posts of the second parallel arrays of vertically extending posts to provide side-to-side stability of the assembly for rigidity of the complete structure and whereby a shopping cart entrance area defined by the parking lot surface and the terminal posts at the corresponding ends of said two first parallel arrays is provided with clearance for the stored shopping carts to be moved therethrough.

2. A facility of claim 1 wherein the laterally spaced apart protective rails are at a distance from the parking lot surface which is less than the height of the stored shopping carts.

3. A facility of claim 2 whereby at least two shopping cart entrance areas defined by the parking lot surface and the terminal posts at the corresponding ends of said two first parallel arrays are provided with clearance for the stored shopping carts to be moved therethrough.

4. A facility of claim 3 further comprising indicia means affixed to at least one of the horizontally extending elements.

5. A facility for storage of shopping carts in a parking lot, or the like, and comprising:

two first parallel arrays of vertically extending posts, each parallel array having a plurality of posts extending in spaced apart relation in the array and including two terminal posts located at the ends of the array, the posts of the first arrays having one end thereof rigidly anchored to the parking lot and terminating in a free end and extending substantially vertically away from the parking lot surface;

coupling means affixed to the free ends of the vertically extending posts;

horizontally extending elements being anchored within the coupling means at the terminals of the vertically extending posts of the first parallel arrays and extending along each said array to define laterally spaced-apart protective rails in combination with the arrays;

two second parallel arrays of vertically extending posts with the posts of the second arrays having one end thereof rigidly anchored in the coupling means affixed to the free ends of the posts of the first arrays of vertically extending posts and terminating in free ends and extending away from said coupling means;

coupling elements affixed to the free ends of the posts in the second parallel arrays;

horizontally extending connecting elements being anchored within the coupling elements of the vertically extending posts of the second parallel arrays and extending along each second parallel array to define laterally spaced-apart rails in planar conjunction with the horizontally extending elements anchored to the first parallel arrays of posts; and cross members extending between the end posts of the second parallel arrays of vertically extending posts to provide side-to-side stability of the assembly for rigidity of the complete structure and whereby a shopping cart entrance area defined by the parking lot surface and the terminal posts at the corresponding ends of said two first parallel arrays is provided with clearance for the stored shopping carts to be moved therethrough.

6. A facility of claim 5 wherein the laterally spaced-apart protective rails are at a distance from the parking lot surface which is less than the height of the stored shopping carts.

7. A facility of claim 6 whereby at least two shopping cart entrance areas defined by the parking lot surface and the terminal posts at the corresponding ends of said two first parallel arrays are provided with clearance for the stored shopping carts to be moved therethrough.

8. A facility of claim 7 further comprising indicia means affixed to at least one of the horizontally extending elements.

* * * * *